United States Patent [19]

Takagi et al.

[11] Patent Number: 4,963,785

[45] Date of Patent: Oct. 16, 1990

[54] FLUORESCENT LAMP UNIT

[75] Inventors: Masami Takagi; Masahiko Aoyagi, both of Yokohama, Japan

[73] Assignee: Toshiba Lighting & Technology Corporation, Tokyo, Japan

[21] Appl. No.: 373,582

[22] Filed: Jun. 30, 1989

[30] Foreign Application Priority Data

Jul. 6, 1988 [JP] Japan ..... 63-166820

[51] Int. Cl.[5] ..... H01J 5/48

[52] U.S. Cl. ..... 313/318; 362/416

[58] Field of Search ..... 313/318; 362/368, 369, 362/370, 371, 416

[56] References Cited

U.S. PATENT DOCUMENTS 3,245,026 4/1966 Pistey ..... 313/318

4,244,012 1/1981 Hansen et al. ..... 362/416 X

FOREIGN PATENT DOCUMENTS 1009598 11/1965 United Kingdom ..... 313/318

*Primary Examiner*—Kenneth Wieder

*Attorney, Agent, or Firm*—Foley & Lardner, Schwartz, Jeffery, Schwaab, Mack, Blumenthal & Evans

[57] ABSTRACT

This invention relates to a fluorescent lamp unit which comprises a fluorescent lamp, and fluorescent-lamp mounting members mounted at end portions of the fluorescent lamp and for fixing the fluorescent lamp to other members. Between the fluorescent-lamp mounting members and the end portions of the fluorescent lamp, there are provided elastic means mounted so that the fluorescent-lamp mounting members can rotate by an angle not less than 1° relative to the fluorescent lamp, or elastic means mounted so that the fluorescent-lamp mounting means can deflect by not less than 0.1 mm in a longitudinal direction of the fluorescent lamp. The elastic means may be layers of an adhesive. The fluorescent-lamp mounting members may also include screwing means.

6 Claims, 2 Drawing Sheets

FLUORESCENT LAMP UNIT

BACKGROUND OF THE INVENTION

1. Field of the Invention

This invention relates to an improvement in the configuration of a fluorescent lamp unit having a mounting member to an apparatus and the like.

2. Description of the Prior Art

Fluorescent lamp units which are relatively small in size are being used for backlight of liquid crystal televisions, OA apparatuses and the like. Fluorescent lamps used in these fluorescent lamp units are those which use bases of, for example, G5, G13 and the like defined in JISC-7709 "bases and sockets for electric lamps" as their bases, those in which cylindrical holders made of 66 nylon are crowned at ends of wire bulbs, and the like. In the above-described conventional bases and holders, base pins of bases function as both elastic fixing and electric connection together with sockets, and hence wire bulbs and bases must be firmly fixed together. Accordingly, bases are bonded to a wire bulb of a fluorescent lamp by base cement or a thermoplastic adhesive which softens when heated at a low temperature and solidifies at room temperature. Its bonding strength is large, and bases and holders are configured so that they can not be easily moved. Recently, when a fluorescent lamp unit is mounted in an OA apparatus and the like for the purpose of reducing a volume occupied by a lamp, a wire bulb of a fluorescent lamp is fixed by directly assembling through holes in supports provided at mounting members of the above-described holders by, for example, screwing and the like. However, since the wire bulb of the fluorescent lamp and the holders are strongly bonded together, a force is applied at connecting portions between the wire bulb of the fluorescent lamp and the holders due to the above-described assembling, and there occur problems that the wire bulb peels from the mounting member of the holder or the bulb is broken with the force.

3. Problems Which the Invention Intends to Solve

As described above, in a conventional fluorescent lamp unit, since connection between holders of mounting members and a wire bulb is strong, there are problems that connecting portions between the mounting members and the wire bulb peel, or the bulb is broken.

SUMMARY OF THE INVENTION

The present invention has been made in order to prevent the above-described problems. It is an object of the present invention to provide a fluorescent lamp unit in which peeling between a wire bulb and mounting members of holders and the like or breaking of the bulb hardly occurs.

A fluorescent lamp unit of the present invention is characterized in that fluorescent-lamp mounting members of the unit are mounted at end portions of a fluorescent lamp by elastic means which rotate by an angle not less than 1° in a circumferential direction of the fluorescent lamp or deflect by not less than 0.1 mm in a longitudinal direction of the fluorescent lamp. In another aspect of the invention, the elastic means consist of an adhesive, and bases or holders are fixed to an apparatus by screwing means.

In a fluorescent lamp unit of the present invention, for fluorescent-lamp mounting members for fixing a fluorescent lamp to an apparatus and the like, there is provided elastic means which rotate by an angle not less than 1° in a circumferential direction of the fluorescent lamp or deflect by not less than 0.1 mm in a longitudinal direction of the fluorescent lamp. The elastic means bond the fluorescent lamp to the mounting members by, for example, a silicone-resin system adhesive. Since the above-described adhesive has elasticity, portions between the fluorescent lamp and the holders can rotate by an angle not less than 1° along a circumferential direction of the fluorescent lamp, and can also deflect by not less than 0.1 mm in a longitudinal direction of the fluorescent lamp. By the above-described rotation by an angle not less than 1° and deflection by not less than 0.1 mm in a longitudinal direction of the lamp, it is possible to prevent breaking of the bulb and peeling of bases or holders from the wire bulb. The effect is remarkable, especially when screwing means are provided at bases or holders.

When the above-described rotating angle is less than 1°, the situation is almost identical to a non-rotatable state, and not preferable since no effect appears. When deflection of the wire bulb in a longitudinal direction is less than 0.1 mm, the situation is also identical to a non-deflectable state, and not preferable since no effect appears.

DESCRIPTION OF THE PREFERRED EMBODIMENTS

Figure 1:
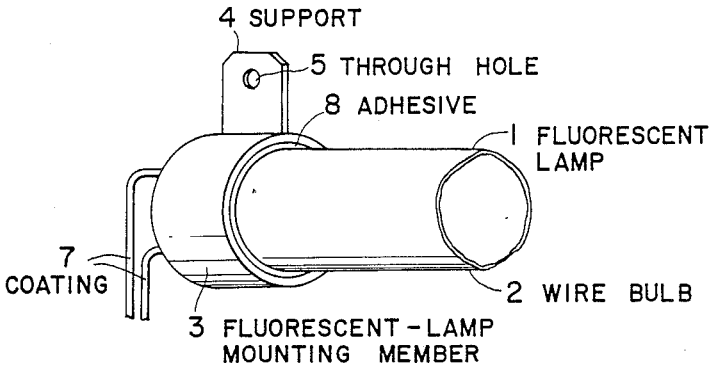
FIG. 1 is a partially-cutaway perspective view of an embodiment of a fluorescent lamp unit of the present invention.
Figure 2:
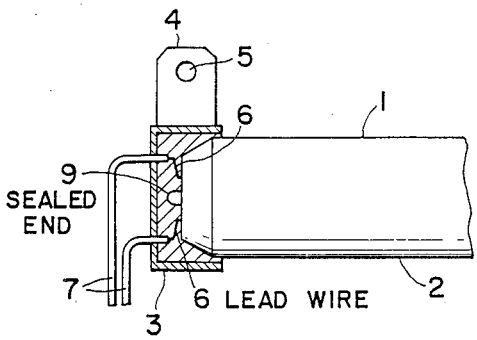
FIG. 2 is a partially-cutaway front view of the embodiment.

Details of fluorescent lamp units of the present invention will be explained with reference to embodiments shown in the attached drawings. FIG. 1 is a partially-cutaway perspective view of an embodiment of a fluorescent lamp unit of the present invention, and FIG. 2 is a partially-cutaway front view of the embodiment. A fluorescent-lamp mounting member (3) is mounted at an end portion of a wire bulb (2) of a fluorescent lamp (1). There is provided a support (4) for fixing the fluorescent lamp to an OA apparatus and the like at the mounting member (3). A screw or the like is threaded through a through hole (5) in the support (4) of the mounting member (3), and the mounting member (3) is fixed to an OA apparatus and the like by screwing means (not illustrated). There are also shown lead wires (6) derived from a discharge electrode (not illustrated) sealed to the wire bulb (2), and coatings (7) through which the lead wires (6) are threaded. The mounting member (3) is mounted to an end portion of the wire bulb (2) by an adhesive (8). There is also shown a sealed end (9) of an exhaust tube of the wire bulb (2). The adhesive (8) is, for example, a silicone-resin system adhesive, and constitutes elastic means which has an enough elasticity capable of rotating by an angle not less than 1° in a circumferential direction of the wire bulb (2). The adhesive (8) also has an elasticity of not less than 0.1 mm in a longitudinal direction of the wire bulb (2). Accordingly, in this fluorescent lamp unit, it is possible to prevent peeling between the wire bulb and a base and breaking of the wire bulb even if a force is applied in either of rotating direction and longitudinal direction of the wire bulb.

Figure 3:
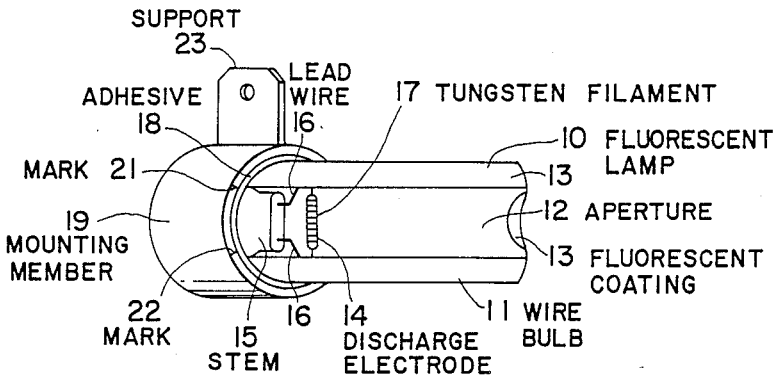
FIGS. 3 and 4 are partially-cutaway perspective views of another embodiment of a fluorescent lamp unit of the present invention in which an aperture-type fluorescent lamp is used.
Figure 4:
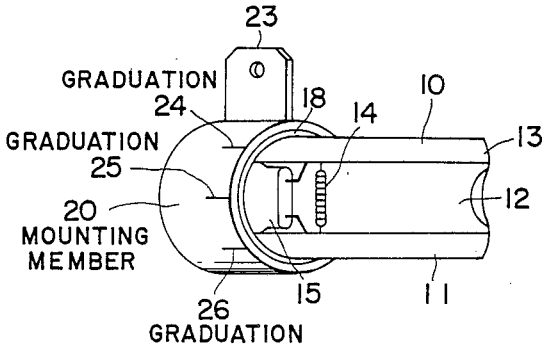

In the above-described embodiment, although elasticity is provided both in rotating direction and longitudinal direction of the fluorescent lamp, a considerable effect may also be obtained even if elasticity is provided only in either one of the above-described directions. FIGS. 3 and 4 are partially-cutaway perspective views of another embodiment of a fluorescent lamp unit of the present invention in which an aperture-type fluorescent lamp is used. A fluorescent coating (13) is coated on the inner surface of a wire bulb (11) of a fluorescent lamp (10) except at an aperture (12). In a discharge electrode (14) sealed at an end portion of the wire bulb (11), a tungsten filament (17) coated with an electron-emitting material is connected between lead wires (16) and (16) planted on a stem (15). A silicone-resin system adhesive (18) mounts mounting members (19) and (20) to the wire bulb (11), and constitutes elastic means which rotates by an angle not less than 1° in a circumferential direction of the wire bulb (11) and deflects by not less than 0.1 mm in a longitudinal direction of the bulb (11) as in the above-described embodiment. On the mounting member (19), at least two marks (21) and (22) are marked at a distance equivalent to the opening size of the aperture (12) on a surface facing the wire bulb (11) as marks capable of collating the aperture (12). Accordingly, by mounting the mounting member with arranging end portions of the aperture (12) with the marks (21) and (22) of the mounting member (19), it is possible to open the aperture (12) between the marks (21) and (22) of the mounting member (19), and an adjustment by the bonded adhesive (18) can be performed relative to rotation and deflection in a longitudinal direction after the mounting member (19) has been fixed to an OA apparatus and the like by a support (23). In the case of the mounting member (20) in FIG. 4, among graduations (24), (25) and (26) marked at the side surface as marks of the mounting member (20), the graduation (25) may be adjusted with the center of the aperture (12). The marks for the aperture of the mounting member used in the embodiments in FIGS. 3 and 4 may also be made by performing equidistance cuttings at a surface facing the wire bulb of the mounting member, or by providing grooves or protrusions having a spacing corresponding to the aperture spacing on the inner surface or the outer surface of the mounting member, other than those shown in FIGS. 3 and 4. Furthermore, the fluorescent lamp is not limited to of an aperture type, but may also be of a reflection type. In any case, an effect can be provided when the lamp is applied to a configuration in which it is firmly fixed to an OA apparatus and the like by supports and the like of mounting members without providing pin bases as in the conventional case.

Although there has been illustrated a case in which the supports of the mounting members for an OA apparatus are mounted in parallel with the wire bulb, they may also be mounted perpendicularly to the longitudinal direction of the wire bulb.

EFFECTS OF THE INVENTION

As described above in detail, a fluorescent lamp unit of the present invention is characterized in that, for fluorescent-lamp mounting members for fixing a fluorescent lamp for backlight of a liquid crystal television, an OA apparatus and the like, there is provided elastic means which rotate by an angle not less than 1° in a circumferential direction of a wire bulb and deflects by not less than 0.1 mm in a longitudinal direction of the wire bulb, and has the particular effects that connecting portions between the wire bulb and the mounting members do not peel from each other when mounted to the above-described OA apparatus and the like, and a force applied to the connecting portion can be absorbed by elastic means consisting of, for example, an adhesive and the like, which rotate or deflect in a longitudinal direction. The effects are remarkable especially when the fluorescent-lamp mounting members have screwing means.

What is claimed is:

1. A fluorescent lamp unit comprising:

a fluorescent lamp;

fluorescent-lamp mounting members mounted at end portions of the fluorescent lamp, for fixing said fluorescent lamp to other members; and elastic means interposed between said fluorescent-lamp mounting members and said end portions of the fluorescent lamp, and mounted so that said fluorescent-lamp mounting members can rotate by an angle not less than 1° relative to said fluorescent lamp.

2. A fluorescent lamp unit according to claim 1, wherein said elastic means consist of an adhesive having an elasticity.

3. A fluorescent lamp unit according to claim 1, wherein said fluorescent-lamp mounting members include screwing means.

4. A fluorescent lamp unit comprising:

a fluorescent lamp;

fluorescent-lamp mounting members mounted at end portions of the fluorescent lamp, for fixing said fluorescent lamp to other members; and elastic means interposed between said fluorescent-lamp mounting members and said end portions of the fluorescent lamp, and mounted so that said fluorescent-lamp mounting members can deflect by not less than 0.1 mm relative to a longitudinal direction of said fluorescent lamp.

5. A fluorescent lamp unit according to claim 4, wherein said elastic means consist of an adhesive having an elasticity.

6. A fluorescent lamp unit according to claim 4, wherein said fluorescent-lamp mounting members include screwing means.

* * * * *